US005419508A

United States Patent [19]

Pierce

[11] Patent Number: 5,419,508

[45] Date of Patent: May 30, 1995

[54] CABLE WINDING DEVICE FOR ELECTRICALLY POWERED MINING VEHICLES

[76] Inventor: Steve Pierce, 625 Saratoga Dr., Green River, Wyo. 82935

[21] Appl. No.: 96,298

[22] Filed: Jul. 26, 1993

[51] Int. Cl.[6] ..... B65H 75/42

[52] U.S. Cl. ..... 242/386; 242/397.3; 242/403; 242/407

[58] Field of Search ..... 242/386, 390.6, 390.9, 242/397.3, 403, 407, 613.2, 613.3, 537

[56] References Cited

U.S. PATENT DOCUMENTS

| | | | |
|---|---|---|---|
| D. 288,496 | 2/1987 | Brownlie | 242/407 |
| 2,941,746 | 6/1960 | Hunt | 242/386 |
| 3,025,019 | 3/1962 | Aschinger | 242/386 |
| 3,061,233 | 10/1962 | Dudley . | |
| 3,386,682 | 6/1968 | Bajek | 242/386 |
| 3,889,896 | 6/1975 | O'Hara | 242/386 |
| 4,258,834 | 3/1981 | Hawley et al. . | |
| 4,583,700 | 4/1986 | Tschurbanoff . | |
| 4,890,957 | 1/1990 | Rinas | 242/386 |

*Primary Examiner*—John M. Jillions
*Attorney, Agent, or Firm*—Dennis L. Mangrum

[57] ABSTRACT

A storage reel for evenly winding and unwinding heavy electrical feeder cable is mounted on the side of a mining vehicle. The storage reel is mounted so as to be stationary on the vehicle. The orbital carriage revolves around the reel evenly winding or unwinding the cable. The reel is shaped in an elongated oblong to maximize the cable storage for use on restricted low profile mining equipment. The device is suited for use on vehicles in mining operations and does not require the use of split rings, rotating collector rings, brushes, or the like for electrical connection, but permits power to pass through the cable from the power source to the vehicle without intervening electrical connectors.

3 Claims, 2 Drawing Sheets

CABLE WINDING DEVICE FOR ELECTRICALLY POWERED MINING VEHICLES

BACKGROUND OF THE INVENTION

1. Field of the Invention

This invention relates to an electrical cable reel for use in mining operations that is mounted to the side of a mining vehicle; the reel stores sufficient cable and is capable of winding and unwinding the cable as the vehicle moves about in a mining tunnel.

2. Description of the Prior Art

Almost all power utilized to operate equipment and machinery in mining operations is electrical. Mining operations require highly specialized equipment that either dump, haul, or bore tunnels into the rock or other strata as they move about in mining operation. These vehicles have to be moveable, and they have to have the capability of operating in confined, small locations, like mine tunnels. A typical vehicle would be a miner. A miner is a vehicle which bores into the rock, or other strata by the use of tools and other implements on the front of the vehicle. The rock ore that has been excavated at the front end, is conveyed to the rear of the vehicle, and dumped into other vehicles for hauling to other locations or for removal to surface. These vehicles are operated by electricity from flexible cables that carry very high voltage. The fact that these vehicles are moveable requires that they be capable of carrying their own electrical cable so that they always have direct power, sufficient for their operation. The handling of the cable is a major problem since the vehicles move about freely and the excess cable must be handled in some way, and there must be sufficient cable stored to permit travel to work stations. In the past, most mining vehicles that were electrically driven employed manual labor of individual workers, who simply dragged or reeled the electrical cable as the machine or vehicle moved about in the mine tunnels. Such work was dangerous, because of standing water, high voltage, and heavy cable.

There are, however, numerous known mechanical devices for spooling and/or handling electrical cables of mining vehicles as they move about in mining tunnels. All known devices have inherent defects or problems involved with their use.

The single most serious problem of known devices is the method or transferring electrical current from the cable to the vehicle. In most known devices, a rotating drum or reel is utilized onto which the cable is spooled. In all devices that utilize rotating drums to reel the cable, slip-rings, rotating collector rings, brushes or the like are employed to transfer power from the cable to the mining equipment. Two of many examples are U.S. Pat. Nos. Dudley 3,061,233, and Tschurbanoff 4,583,700. Others employ the same technology. These slip rings and the like are potentially dangerous in mining operations. Mining regulations (see part 18.43 of 30 CFR ch 1 of Mine Safety and Administration) require that all such slip-rings and the like be contained within explosion proof boxes and even when that is done, those connectors are unreliable and wear prone, due to the severe environment conditions of a mine. They are also expensive, complicated, and ineffective. Additionally, the explosion proof enclosures are large and utilize excess amounts of space on the mining vehicle.

A more recent system for storing cables is described in U.S. Pat. No. 4, 258,834, issued to Hawley. There, no slip-rings are employed. There, cable is dumped or pulled into or out of a large drum. The cable is fed through a round sleeve in which are disposed frictional devices which engage the cable and pull it into the drum. Many problems exist with this device. One is that not all cable is round. Some cable is flat, oblong, etc. The devices makes no allowance to handle other than round cable. The stationary drum of Hawley, does resolve the electrical connection problems the cable to be connected directly to the vehicle without the use of slip rings or dangerous connectors.

The device contained in Hawley, however, has some additional problems that are inherent in the design of the device, and other prior art stationary drum applications. In Hawley, the cable is deposited into a drum by a rotating arm, and the cable is supposed to stack systematically, simply by the weight of the cable forcing it into place. The problem is that the cable is pulled into the drum by friction type devices which squeeze the cable and pull it through the feeding fair-lead. Once the cable is clamped and squeezed, it restricts twisting of the cable, so when the cable is dumped into the container, it will twist, wrinkle, and not stack in any uniform manner. Such stacking decreases the available space for storage of the cable in the drum, and is, in reality, not usable for the reason above. Space, particularly for the drum storage of electrical cable, is very limited and must be kept to a minimum. There is no method available to utilize another known element to systematically stack the cable. The design is defective.

Another problem with Hawley is that most mining vehicles must utilize the rear of the vehicle for mining operations. In Hawley, the container and storage bin is directly behind the vehicle and that location is noted as being essential to its usage. Such a device could not be used in most mining vehicle applications, simply because of the position of the drum. As previously noted, the rear of most mine vehicles can not be utilized for reeling of cable because of other operations, such as hauling and dumping of ore. The miner, for instance, cuts rock from the front and conveyors it to the rear for dumping and hauling. The drum of Hawley could not be used with a miner or other vehicles utilizing the rear of the vehicle. In operation it is also desirable that the unwound cable be placed at the side of the tunnel. If the cable is disposed or unwound and placed into the middle of the tunnel, it gets in the way of all other vehicles that may be moving in or about the tunnel. Such cables impede traffic flow, and cause safety problems for other vehicles.

Lastly, cables have splices and are irregular in shape, and the device in Hawley does not provide for the variable size or shaped cables. Such splices, etc., could jam Hawley and make it inoperable and dangerous.

There are devices like Dudley, supra, that utilize side mounted rotating reels. However, there is no known device which use a stationary side mounted reel for the storage and unwinding and winding of electrical cables, in mining vehicles.

These and other problems of the prior art devices are resolved by the present invention, which is described hereinafter.

SUMMARY OF THE INVENTION

An elongated oblong shaped stationary reel is disposed on the side of a mining vehicle. An orbital carriage is situated to travel around the reel, either winding or unwinding electrical cable from or onto the reel in a systematic manner so as to maximize cable storage. The stationary reel permits electrical power to flow through the cable from the primary power source directly to the vehicle without the use of electrical connectors, such as slip rings, etc. The elongated oblong shape of the reel and systematic winding maximizes cable storage without modification of the mining vehicle. The orbiting carriage is hydraulically driven so as to apply a predetermined tension to the cable as it is unwinding, and to permit a uniform winding pattern while the cable is being wound on the reel. The orbital carriage is chain driven around the reel on a carriage track and gear rack, formed as part of the outer portion of the reel and places cable at the side of the tunnel so that it is out of the travel path of other mining vehicles.

It is an object of the present invention to eliminate any electrical connectors, ie., slip rings, rotating connector rings, brushes, or the like, between the power source and the mining vehicle, by utilizing a stationary reel.

It is an object of the present invention to systematically and uniformly wind cable on an elongated oblong stationary reel, so as to maximize cable storage.

It is an object of the present invention to wind and unwind cable under a constant and predetermined pressure to maximize cable storage and prevent kinks, bends, and whipping of the cable.

It is an object of the invention to provide a device that is hydraulically operated to improve mine safety in the handling of electrical cables.

It is an object of the present invention to provide a stationary reel mounted to the side of the vehicle to keep the rear of the mining vehicle free so as to not interfere with other operations and equipment at the rear of the vehicle.

It is another object of the invention to provide a reel that will unwind cable and place it at the side of a mining tunnel rather than in the middle, where it interferes with mining activities.

It is an object of the invention to wind and unwind electrical cable from a stationary reel attached to the side of a mining vehicle without damaging the cable by squeezing the cable.

DETAILED DESCRIPTION OF THE PREFERRED FORM OF THE INVENTION

Figure 1:
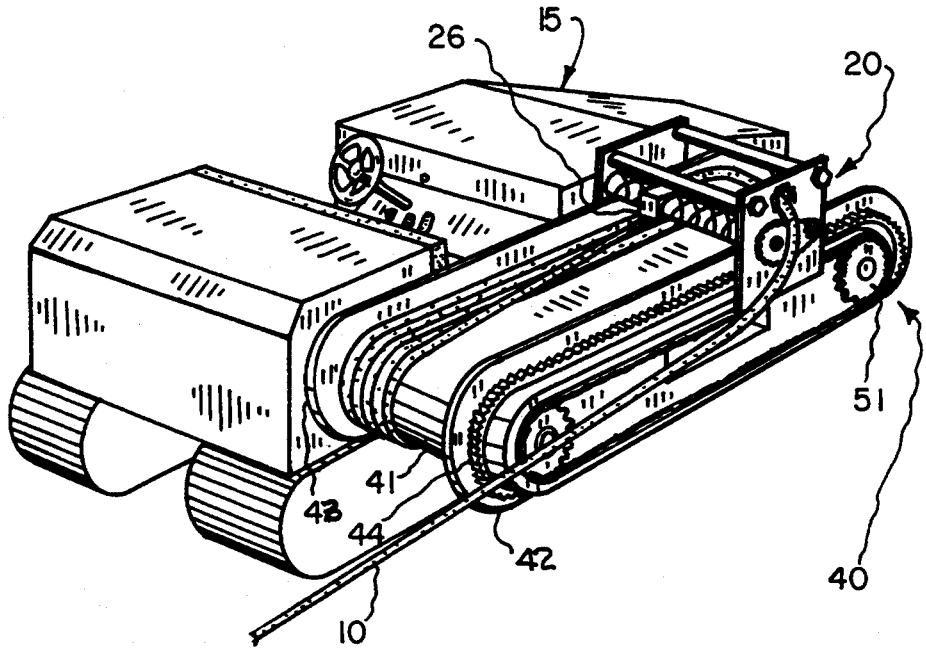
FIG. 1 is a isometric view of a mining vehicle with the cable reeling system installed thereon.

A conduit winding system 5 is shown mounted in FIG. 1 on the side of a mining vehicle 15. The mounting system 5 is adapted to wind and unwind electrical cable 10 from a stationary reel 40, as the mining vehicle 15 moves about in a mining tunnel. The system 5 is comprised of main elements, including: an elongated oblong storage reel 40 having formed as a part thereof carriage and gear racks 44 disposed near the outer edge 52 of the side 42, FIG. 4, of the stationary reel 40; an orbital carriage 20 mounted so as to revolve around the elongated reel 40, as cable 10 is wound and unwound around the reel 40. A level wind shaft (well known in the art) 32 is coupled to the orbital carriage 20 which accepts cable 10 through fair-lead rollers 35, thereby permitting cable to be wound onto the reel 40 in a systematic manner to maximize cable storage. The system 5 is mounted to the side of the mining vehicle by bolting of the support arms 11, shown in phantom lines in FIG. 2, to the side of the vehicle, where mounts are disposed and are adapted to receive the support arms (not shown). The technique of mounting is well known in the art and is not further described in this invention.

Figure 2:
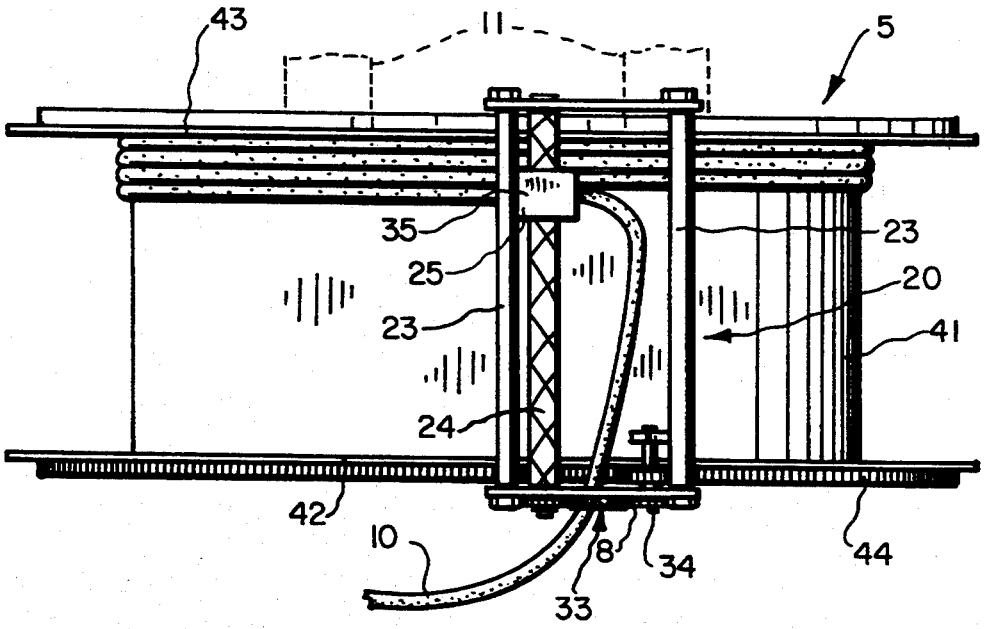
FIG. 2 is a top plan view of cable reeling system.
Figure 4:
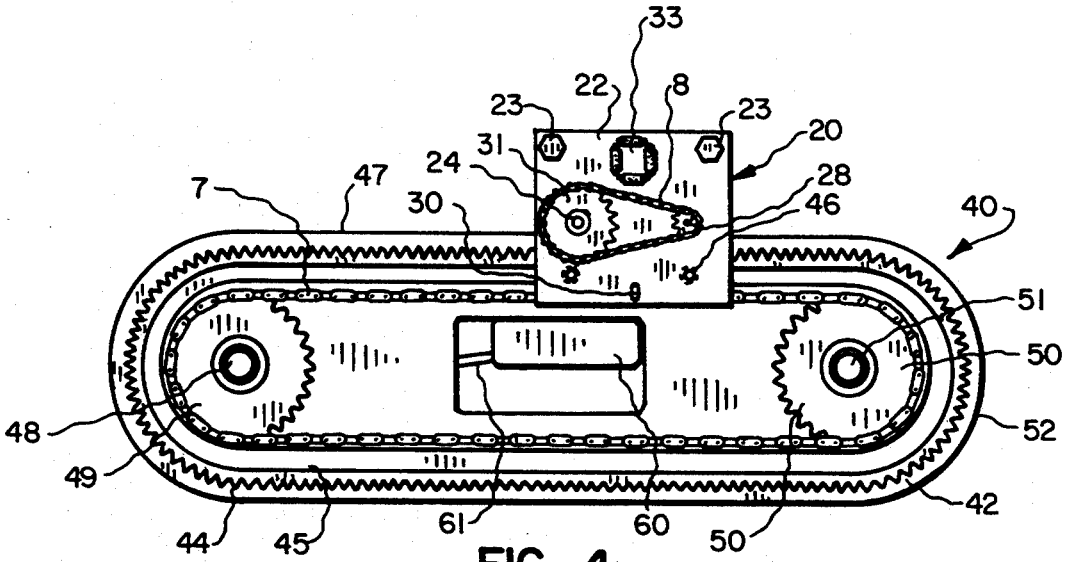
FIG. 4 is a side view of the present invention.

The stationary reel 40 is typically fabricated of heavy duty steel, and has an inner drum 41 that is elongated and oblong in shape, as shown in FIG. 1. The inner drum is coupled to an outer side 42 and inner side 43 as shown in FIG. 2. These side pieces are also made of heavy gauge steel and form the sides of the reel 40. A carriage track 44 is coupled to the outer face of the outer side 42. The carriage track has gear teeth which are capable of engaging an idler gear 28 of the orbital winder 20. The carriage track 44 is shown in FIG. 4. An inner carriage track 45 is disposed inward from carriage track 44, and is also coupled to the outer face 42. Both carriage tracks 44 and 45 are capable of receiving and containing cam follower wheels 46 and 47 of the orbital winder to enable the wheels to move around the elongated drum 40. A power sprocket 48 is disposed toward the forward end of the inner drum 41 that has coupled thereto a sprocket 49. The sprocket 49 is adapted to receive a roller drive chain 55. An opposite sprocket 50, which is identified as idler sprocket 50, is disposed toward the other end of the elongated reel 41, and has an idler shaft 51. Link drive chain 55 is fitted to extend around and between drive sprocket 49 and idler sprocket 50.

A hydraulic motor 60, FIG. 4, is disposed inside of reel 41 and is driven by hydraulic lines (not shown) originating in the mining vehicle. The hydraulic motor 60 is coupled to drive shaft 48 (not shown) by methods well known in the art, from which power is derived to operate winding and unwinding of cable 10 as described more fully hereinafter. The hydraulic motor 60 provides constant power to drive shaft 48 and the operation of the device 5 is described hereinafter.

The technology of hydraulic motors and constant tension valves are well known in the prior art, and are not discussed in detail in this invention. The fact that hydraulics are used, increases the safely feature of this device for use in mining operation. However, electricity, or other means could be used to power drive shaft 48 without detracting from the spirit or scope of the invention.

The orbiter, 20 has an inside face plate 21 and an outside plate 22 which are capable of being disposed outward of the inner and outer sides 42 and 43 of the reel 40. Connecting spacers 23 extend across the drum, as shown in the FIG. 2, to maintain the integrity of the orbital carriage 20. Idler gear 28, FIG. 2, is adapted and secured to the outside face plate 22 by shaft 34 so as to be able to engage the carriage track 44. Sprocket 28 is coupled to shaft 34 capable or engaging a roller link drive chain 8 which is disposed around the sprocket 28, and around sprocket 31 which is coupled to the level wind shaft 32. The idler gear is designed so as to be capable of driving level wind shaft 24 to rotate so as to move the level wind follower 25 across the level wind shaft an amount equal to the width of the cable, for each rotation of the orbiter 20. Level wind shaft 24 is well known in the art, and has coupled thereto a level wind follower 25 as shown in FIG. 2. Also coupled to the level wind follower 25 is the roller fair-lead 35 (FIG. 3), which is capable of receiving electrical cable 10 therethrough, and directing it in cooperation with the level wind 24 to the reel 40 for systematic winding to maximize storage space on the reel for the cable 10. The roller fair-lead 35 aids the cable 10 to be pulled under pressure without damaging the cable as does roller fair-lead 33.

Figure 3:
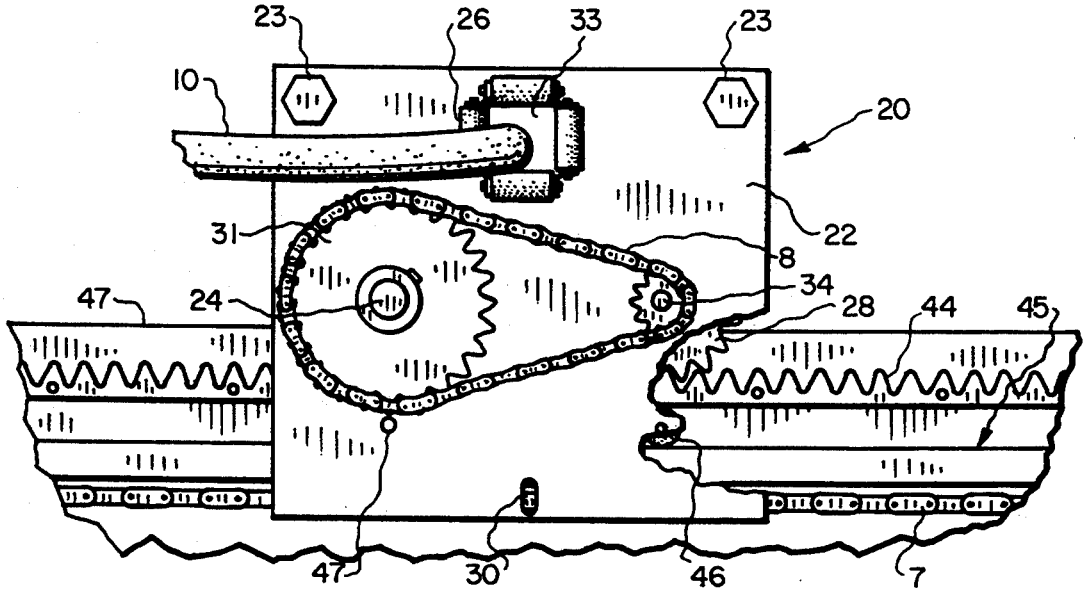
FIG. 3 is a partial view, showing the orbital carriage of the present invention.

The orbiter 20 is coupled to master link chain 7 by means of a carrier link 30, FIG. 3. When the mining vehicle moves backwards, the static force applied by the hydraulic motor 60 will be overcome. The orbiter will move clockwise to pick up cable. Sprocket 49 will drive chain 7 which in turn drives idler sprocket 50, link chain 8, and the level wind shaft 24. The orbiter 20 will move clockwise around the stationary reel 40 winding cable onto the reel 40 due to the orbiter 20 retrieving cable as it moves with chain 7 around the stationary reel 40.

Cable 10 is initially threaded through fair-lead 33 in the face of the plate 22 of the orbiter. It then passes through a second roller fair-lead 35 attached to the level wind follower 25 and then around inner drum 41. The hot end of the cable 10 is taken directly through an aperture in the inner drum 41 (not shown), and coupled directly to the power receiving portion of the mining device. This coupling is not shown, but is well known in the art, and does not include slip rings or the like. It provides a direct connection of the cable 10 between the power source and the receiving unit of the vehicle.

The hydraulic motor 60 that drives sprocket 49 can be controlled by the driver of the mine vehicle 15 or it will be automatically activated by the static pressure. At all times the vehicle is in operation, the hydraulic motor 60 supplies a constant force to drive shaft 48, which in turn supplies power to sprocket 49 and link chain 7. The predetermined force, is set to oversome the static force created by the cable being used. When the mining vehicle is stationary, the orbiter is stationary, but exerts a force on cable 10. The orbiter 20 will not move until the hydraulic pressure is increased intentionally by the operator to pick up cable slack; or unless the mining vehicle moves backwards, then the standing pressure or force will cause the orbiter 20 to move clockwise and spool cable onto reel 41, while maintaining the constant pressure. The level wind 24 and fair-leads 33 and 35 will ensure that cable 10 is wrapped on the inner drum 41 under a constant pressure and in a systematic manner so that cable storage is maximized. This pressure (that can be set to any predetermined level that is most suited for the particular operation and speed of the vehicle), however, keeps a constant tension in the electrical cable. Once the vehicle moves forward, the force of the mining vehicle 15 will overcome the standing level hydraulic pressure on the orbiter 20, and the cable 10 will be automatically un-spooled under tension as the orbiter 20 is driven counter clockwise around the reel 41, thereby unwinding the stored cable.

The hydraulic motor and system is designed such that a safety valve will release all force on the orbiter if any sudden movement by the vehicle occurs, which might put undo stress on the cable 10, thereby preventing damage to the cable 10.

It is important that this device be installed on the side of the mining vehicle 15 (see FIG. 1), for the following reasons: First, as the cable 10 is picked up or laid down by the device 5, it will do so, so that the cable 10 is placed toward the right hand edge of the mining tunnel. This keeps the cable 10 out of the main travel portion of the tunnel and out the way of other mining vehicles and equipment that also need to use the tunnel. Second, the device, by being mounted on the side, does not interfere with normal mining operations, which typically use the rear of the vehicle for hauling or processing mined rock or the like. Third, the operator of the vehicle 15 is always able to visually monitor the operation of the device 5 at all times, which is not possible in rear mount devices. This is critical, since the power lines that are used carry large currents and damage to the cable could expose serious harm not only the driver, but other mine workers.

One of the most important features of this device, is that no slip rings, rotating collectors, brushes, or the like are needed in order to permit the current to flow through the electrical cable from the power source directly to the mining vehicle. This feature, as well as the others identified herein, provide a new invention not known in the prior art that lends safety and efficiency to a system for mechanically winding, storing, and unwinding electrical cable from a stationary reel in a mining vehicle.

Another feature of this invention is that the device will handle any size or shape of electrical cable, be it flat, round, or any other shape. The cable can have splices and vary in diameter and not affect the operation of this device.

The preferred embodiment of the invention has been described. Various changes can be made to that embodiment without detracting from the spirit or scope of the invention.

I claim:

1. A device for storing, winding, and unwinding flexible cable from a moving mining vehicle, said device mounted on the side of said vehicle comprising of:

a) a stationary elongated shaped reel, having a gear rack and orbital carriage track, capable of storing said flexible cable;

b) an orbital carriage capable of engaging said orbital carriage track and rotating around said stationary reel for systematically winding said cable onto said reel; and c) a roller chain capable of engaging said orbital carriage causing said orbital carriage to rotate around said gear rack and carriage track;

wherein said elongated oblong shaped reel permits the storage of significant amounts of said flexible cable while optimizing the amount of space available for storage, and minimizing the amount of space used on said mining vehicle, said stationary reel also permitting electricity to flow uninterrupted in said cable from a power source to said mining vehicle without the use of split rings or the like, said device disposed on the side of said mining vehicle so as to not interfere with mining operations being conducted at the front or rear of said vehicle, and to unwind said cable at the side of the mine tunnel and out of the way of mining operations and traffic.

2. The device of claim 1 wherein said orbital carriage has a roller fair-lead coupled to a level wind shaft for collecting said flexible cable, and for winding and unwinding it from and onto said stationary reel in a systematic manner.

3. The device of claim 1 wherein said orbital carriage is driven around said orbital carriage track by a hydraulic means capable of supplying a predetermined force to said cable as it is being wound and unwound.

* * * * *